US009984534B2

(12) United States Patent
Trainor

(10) Patent No.: US 9,984,534 B2
(45) Date of Patent: May 29, 2018

(54) ENHANCED GAMING MACHINE WITH INTERACTIVE BONUS

(71) Applicant: IGT CANADA SOLUTIONS ULC, Moncton (CA)

(72) Inventor: Bethany Trainor, Dieppe (CA)

(73) Assignee: IGT CANADA SOLUTIONS ULC, Moncton (CA)

( * ) Notice: Subject to any disclaimer, the term of this patent is extended or adjusted under 35 U.S.C. 154(b) by 50 days.

(21) Appl. No.: 15/073,126

(22) Filed: Mar. 17, 2016

(65) Prior Publication Data

US 2016/0275748 A1 Sep. 22, 2016

Related U.S. Application Data

(60) Provisional application No. 62/134,249, filed on Mar. 17, 2015.

(51) Int. Cl.
*A63F 9/24* (2006.01)
*G07F 17/32* (2006.01)

(52) U.S. Cl.
CPC ..... *G07F 17/326* (2013.01); *G07F 17/3258* (2013.01)

(58) Field of Classification Search
CPC .. G07F 17/34; G07F 17/3213; G07F 17/3267; G07F 17/326
See application file for complete search history.

(56) References Cited

U.S. PATENT DOCUMENTS 6,835,132 B2 * 12/2004 Bennett ..... G07F 17/3244 463/16
2004/0063493 A1 * 4/2004 Baerlocher ..... G07F 17/34 463/25
2006/0281528 A1 * 12/2006 Hall ..... G07F 17/32 463/20
2008/0064478 A1 * 3/2008 Roukis ..... G07F 17/32 463/20
2008/0227550 A1 * 9/2008 Vallejo ..... G07F 17/3267 463/42
2009/0117984 A1 * 5/2009 Seelig ..... G07F 17/3211 463/20
2009/0247271 A1 * 10/2009 Olive ..... G07F 17/3258 463/20
2011/0117994 A1 * 5/2011 Harvey ..... G07F 17/32 463/20
2014/0094303 A1 * 4/2014 Wabschall ..... G07F 17/3223 463/31

* cited by examiner

*Primary Examiner* — Steve Rowland
(74) *Attorney, Agent, or Firm* — Sage Patent Group

(57) ABSTRACT

Electronic gaming machines with an interactive bonus game. A touch sensitive display device provides an interactive game environment with prize symbols, a pointer, and a selection game zone with masked or covered selector game symbols. A player input device detects player interaction commands to select the game symbols to move the pointer relative to the prize symbols. A graphical animation effect represents movement of the pointer relative to the prize symbols.

20 Claims, 13 Drawing Sheets

210

ENHANCED GAMING MACHINE WITH INTERACTIVE BONUS

FIELD

Embodiments described herein relate to the field of electronic gaming machines.

INTRODUCTION

Casinos and other establishments may have video gaming terminals. Various video gaming terminals or machines may include online gaming systems (that enable users to play games using computer devices, whether desktop computers, laptops, tablet computers or smart phones), computer programs for use on a computer device (including desktop computer, laptops, tablet computers of smart phones), or gaming consoles that are connectable to a display such as a television or computer screen.

Video gaming machines may be configured to enable users to play a variety of different types of games. Players may wager on gaming outcomes to win tangible awards. In a reel type game one or more winning game elements may be displayed. In pattern based games, a winning combination may be defined using a pattern of gaming elements in an arrangement of cells (or an array) of the matrix, where each cell may include a gaming element. Gaming elements may define winning combinations (or a winning pattern). Game symbols may be associated with credits, points or the equivalent.

Example games may involve a matrix or grid of cells, where gaming symbols or elements may be displayed within the cells. A pick-a-prize game may enable a player to select a gaming symbol or element. The selected gaming symbol or element may be used to determine a tangible award for the player based on a winning outcome. A pick-a-prize game may be a primary game, a bonus game or secondary game.

Gaming systems or machines are popular. However, there is a need to compete for the attention of users, and therefore it is necessary to innovate by launching new and engaging game machines.

SUMMARY

In an aspect, there is provided an electronic gaming machine with a card reader to identify a monetary amount conveyed by a token to the electronic gaming machine, at least one data storage device to store game data for an interactive bonus game. A game controller detects bonus feature activation and controls the interactive bonus game. A touch sensitive display device is configured to provide an interactive game environment with an array of prize symbols, a pointer, and a selection game zone comprising a plurality of masked or covered selector game symbols. A player input device continuously detects, at the touch sensitive display device, player interaction commands to select at least one of the selector game symbols to move the pointer relative to the prize symbols of the array, the player selections being limited for a number of selections operational when the bonus game starts due to a trigger mechanism determining the limit. In response to detection by the player input device of a player interaction command, a display controller triggers a graphical animation effect displayed on the display device representative of movement of the pointer relative to the prize symbols of the array to an updated position to trigger a winning outcome of the game for provision of an award based on the prize symbol indicated in the updated position.

In an aspect, there is provided an electronic gaming machine with at least one data storage device to store game data for an interactive bonus game. A game controller detects bonus feature activation to control the interactive bonus game. A display device is configured to display an interactive game environment with an array of prize symbols, a pointer, and a selection game zone comprising a plurality of masked or covered selector game symbols. A player input device detects, at the display device, player interaction commands to select selector game symbols that define and trigger movement of the pointer relative to the prize symbols of the array to a plurality of positions, the player selections being limited for a number of selections operational when the bonus game starts due to a trigger mechanism determining the limit. In response to detection by the player input device of a player interaction command, a display controller triggers a graphical animation effect displayed on the display device representative of movement of the pointer relative to the prize symbols of the array to the plurality of positions to trigger a winning outcome of the game for provision of an award based on the prize symbol indicated in a final position.

Further features and combinations thereof concerning embodiments are described.

DETAILED DESCRIPTION

Embodiments described herein relate to an enhanced electronic gaming machine (EGM) that includes a graphics processor configured to generate gaming animations on a display. The EGM is configured to generate an interactive game environment. The interactive game environment includes an interface that provides a prize selection game zone with masked prize selector game symbols at different prize locations within the interactive environment. When a player makes a selection a new prize selector game symbol becomes visible.

The gaming enhancements described herein may be carried out using a physical EGM. EGM may be embodied in a variety of forms and devices including, for example, portable devices, such as tablets and smart phones, that can access a gaming site or a portal (which may access a plurality of gaming sites) via the Internet or other communication path (e.g., a LAN or WAN). The EGM may be located in various venues, such as a casino or an arcade. One example type of EGM is described with respect to FIG. 1.

Figure 1:
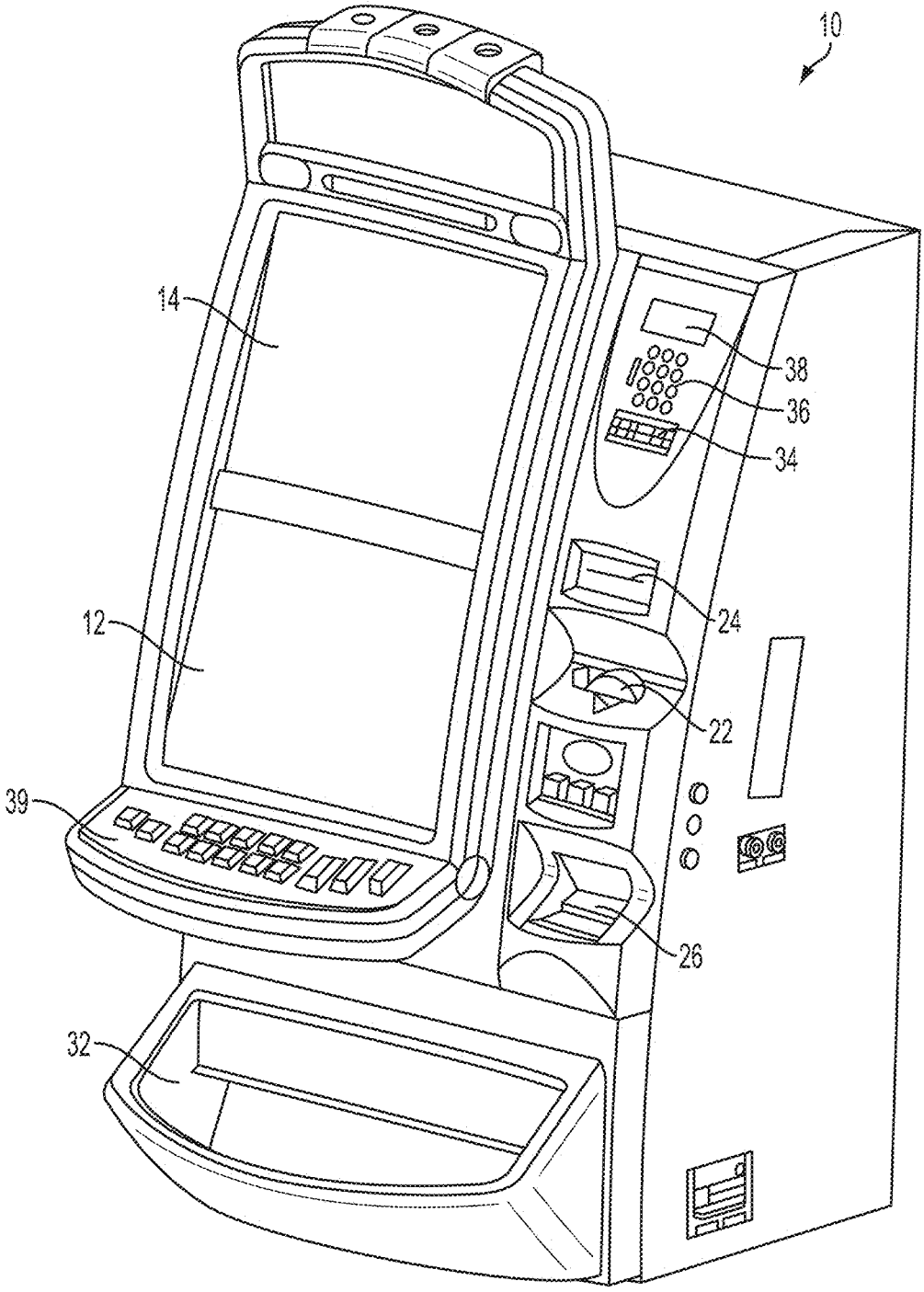
FIG. 1 is a perspective view of an electronic gaming machine for implementing the gaming enhancements according to some embodiments.

FIG. 1 is a perspective view of an EGM 10 configured to provide enhancements. EGM 10 has at least one data storage device to store game data for an interactive bonus game. EGM 10 has a game controller for detecting bonus feature activation and controlling the interactive bonus game.

An example embodiment of EGM 10 includes a display 12 that may be a thin film transistor (TFT) display, a liquid crystal display (LCD), a cathode ray tube (CRT), auto stereoscopic 3D display and LED display, an OLED display, or any other type of display. An optional second display 14 provides game data or other information in addition to display 12. Display 14 may provide static information, such as an advertisement for the game, the rules of the game, pay tables, pay lines, or other information, or may even display the main game or a bonus game along with display 12. Alternatively, the area for display 14 may be a display glass for conveying information about the game. Display 12, 14 may also include a camera, sensor, and other hardware input devices.

At least one display 12, 14 of EGM 10 has an electronic enabled touch sensitive gaming display device that receives touch input from players as player interaction command input to select prize selector game symbols. The touch sensitive display device renders an interactive game environment with an array of prize symbols, a pointer, and a selection game zone as part of an interface. The selection game zone has masked or covered prize selector game symbols. The array of prize symbols may be a ladder of prizes where the starting point for the pointer may be the minimum prize on the ladder.

EGM 10 includes a player input device to continuously detect, at the touch sensitive display device (e.g. display 12, 14) player interaction commands (e.g. touch, gestures) to interact with the selection game zone and select prize selector game symbols. The game symbols may be directional symbols indicating direction of movement of the pointer, path of movement, and the like. The games symbols are masked or covered and revealed once selected. The games symbols may be masked or covered using various configurations in order to block, hide or otherwise conceal the underlying game symbols until selection thereof. The revealed game symbol triggers and defines movement of the pointer relative to the prize symbols of the array. The array may be a ladder of prizes, a circle of prizes, or other layout. The player may have a limited number of available selections. The number may be limited for a number of selections operational when the bonus game starts due to a trigger mechanism determining the limit. EGM 10 maintains a mapping or link between the pointer and the prize symbols of the array to define the movement, which may be stored in data storage device.

EGM 10 has a controller that triggers a graphical animation effect displayed on the display 12, 14 representative of movement of the pointer relative to the prize symbols of the array from an initial position to an updated position. The pointer may move to multiple positions based on multiple selections of prize selector symbols. Selection of additional prize selector game symbols in turn triggers additional graphical animation effects representative of movements of the pointer relative to the prize symbols of the array to multiple positions. EGM 10 may maintain data defining all possible positions that the pointer may move to. The final position of the pointer (after movement to multiple positions) triggers a winning outcome of the game. An award amount may be based on the outcome as indicated in the updated position. At least one sequence of selections of the game symbols provides the winning outcome. The award is based on the prize symbol that the pointer points at a final position or prize position (as there may be intermediate positions) including credits, free games, mega pot, small pot, progressive pot, and so on. After a final selection is made the updated position of the pointer points to the revealed prize for the winning outcome. The controller may interact with display 12, 14 to determine a size of an interface of the display 12, 14 for the interactive game environment and dynamically determining a configuration of the prize symbols of the array based on the size of the interface.

Display 12, 14 may have a touch screen lamination that includes a transparent grid of conductors. Touching the screen may change the capacitance between the conductors, and thereby the X-Y location of the touch may be determined. The X-Y location of the touch may be mapped to positions for the prize selector game symbols to detect selection thereof. A processor of EGM 10 associates this X-Y location with a function to be performed. Such touch screens may be used for slot machines, for example, or other types of gaming machines. There may be an upper and lower multi-touch screen in accordance with some embodiments. One or both of display 12, 14 may be configured to have auto stereoscopic 3D functionality to provide 3D enhancements to the interactive game environment. The touch location positions may be 3D for example and mapped to prize selector game symbols. EGM 10 maintains data for the positions and a mapping between the pointer, the positions and the prize selector game symbols to define the movement of the pointer relative to the prize selector game symbols.

A coin slot 22 may accept coins or tokens in one or more denominations to generate credits within EGM 10 for playing games. An input slot 24 for an optical reader and printer receives machine readable printed tickets and outputs printed tickets for use in cashless gaming.

A coin tray 32 may receive coins or tokens from a hopper upon a win or upon the player cashing out. However, the EGM 10 may be a gaming terminal that does not pay in cash but only issues a printed ticket for cashing in elsewhere. Alternatively, a stored value card may be loaded with credits based on a win, or may enable the assignment of credits to an account associated with a computer system, which may be a computer network connected computer.

A card reader slot 34 may read from various types of cards, such as smart cards, magnetic strip cards, device tokens, or other types of cards conveying machine readable information. The card reader reads the inserted card for player and credit information for cashless gaming. Card reader slot 34 may read a magnetic code on a player tracking card, where the code uniquely identifies the player to a host system at the venue. The code is cross-referenced by the host system to any data related to the player, and such data may affect the games offered to the player by the gaming terminal. Card reader slot 34 may also include an optical reader and printer for reading and printing coded barcodes and other information on a paper ticket. A card may also include credentials that enable the host system to access one or more accounts associated with a user. The account may be debited based on wagers by a user and credited based on a win. The account may be managed by host system which may manage multiple user accounts. Each account may be linked to a user via an identification token, and the like.

The card reader slot 34 may be implemented in different ways for various embodiments. The card reader slot 34 may be an electronic reading device such as a player tracking card reader, a ticket reader, a banknote detector, a coin detector, and any other input device that can read an instrument supplied by the player for conveying a monetary amount. In the case of a tracking card, the card reader slot 34 detects the player's stored bank and applies that to the gaming machine being played. The card reader slot 34 or reading device may be an optical reader, a magnetic reader, or other type of reader. The card reader slot 34 may have a slot provided in the gaming machine for receiving the instrument. The card reader slot 34 may also have a communication interface (or control or connect to a communication interface) to digitally transfer tokens or indicia of credits or money via various methods such as RFID, tap, smart card, credit card, loyalty card, NFC and so on.

An electronic device may couple (by way of a wired or wireless connection, card reader slot 34, or another hardware component) to the EGM 10 to transfer electronic data signals for player credits and the like. For example, near field communication (NFC) may be used to couple to EGM 10 which may be configured with NFC enabled hardware. This is a non-limiting example of a communication technique.

A keypad 36 may accept player input, such as a personal identification number (PIN) or any other player information. A display 38 above keypad 36 displays a menu for instructions and other information and provides visual feedback of the keys pressed.

Keypad 36 may be an input device such as a touchscreen, or dynamic digital button panel, in accordance with some embodiments.

Player control buttons 39 may include any buttons or other controllers needed to play the particular game or games offered by EGM 10 including, for example, a bet button, a repeat bet button, a spin reels (or play) button, a maximum bet button, a cash-out button, a display pay lines button, a display payout tables button, select icon buttons, and any other suitable button. Buttons 39 may be replaced by a touch screen with virtual buttons.

EGM 10 may also include a digital button panel. The digital button panel may include various elements such as for example, a touch display, animated buttons, frame lights, and so on. The digital button panel may have different states, such as for example, standard play containing bet steps, bonus with feature layouts, point of sale, and so on. The digital button panel may include a slider bar for adjusting the three-dimensional panel. The digital button panel may include buttons for adjusting sounds and effects. The digital button panel may include buttons for betting and selecting bonus games. The digital button panel may include a game status display. The digital button panel may include animation. The buttons of the digital button panel may include a number of different states, such as pressable but not activated, pressed and active, inactive (not pressable), certain response or information animation, and so on. The digital button panel may receive player interaction commands to select selector game symbols, in some example embodiments. The digital button panel may be used for player interaction commands.

EGM 10 may also include hardware configured to provide motion or gesture tracking. For example, the EGM 10 may include a camera. The camera may be used for gesture or motion tracking of player, such as detecting player positions and movements, and generating signals defining x, y and z coordinates. For example, the camera may be used to implement tracking recognition techniques to collect tracking recognition data. An example type of motion tracking is optical motion tracking. The motion tracking may include a body and head controller. The motion tracking may also include an eye controller. EGM 10 may implement eye-tracking recognition technology using camera, sensors (e.g. optical sensor), data receivers and other electronic hardware to capture various forms of player input. A gesture or motion by a player may define player interaction commands or components thereof to select selector game symbols, in some example embodiments. Accordingly, EGM 10 may be configured to capture player gesture input as player interaction commands for prize selection.

Embodiments described herein are implemented by physical computer hardware embodiments. The embodiments described herein provide useful physical machines and particularly configured computer hardware arrangements of computing devices, servers, electronic gaming terminals, processors, memory, networks, for example. The embodiments described herein, for example, is directed to computer apparatuses, and methods implemented by computers through the processing of electronic data signals.

Accordingly, EGM 10 is particularly configured to provide an interactive game environment. The display screens 12, 14 may display, via a user interface, the interactive game environment and selector game components or symbols in accordance with a set of game data stored in a data store.

A data capture device may capture player data as player interaction commands, such as button input, gesture input and so on. The data capture device may include a camera, a sensor or other data capture electronic hardware.

Embodiments described herein involve computing devices, servers, electronic gaming terminals, receivers, transmitters, processors, memory, display, and networks particularly configured to implement various acts. The embodiments described herein are directed to electronic machines adapted for processing and transforming electromagnetic signals which represent various types of information. The embodiments described herein pervasively and integrally relate to machines, and their uses; and the embodiments described herein have no meaning or practical applicability outside their use with computer hardware, machines, and various hardware components.

As described herein, EGM 10 may be configured to provide an interactive game environment. The interactive game environment may be an enhancement to a primary game or may be a new game (e.g. secondary game, portal game, or bonus game) that is independent of the primary game. For example, a trigger mechanism for the interactive bonus game may be based on a number of symbols appearing in a base or primary game. The limit of selections may be based on the number of symbols appearing in a base game such that the higher the number of game symbols appearing the higher the number of selections. EGM 10 may determine the limit of selections dynamically in real-time based on game events or other factors. The interactive game environment may be provided dynamically and revealed by dynamic triggers from game content of the primary game in response to electronic data signals collected and processed by EGM 10.

For an interactive 3D environment, the EGM 10 may include a display 12, 14 with auto stereoscopic three-dimensional functionality. The EGM 10 may include a touch screen display for receiving touch input data to define player interaction commands. The EGM 10 may also include a camera, for example, to further receive player input to define player interaction commands. The EGM 10 may also include several effects and frame lights. The 3D enhancements may be an interactive 3D game environment for additional prize selector game components or symbols.

EGM 10 may include an output device such as one or more speakers. The speakers may be located in various locations on the EGM 10 such as in a lower portion or upper portion. The EGM 10 may have a chair or seat portion and the speakers may be included in the seat portion to create a surround sound effect for the player. The seat portion may allow for easy upper body and head movement during play. Functions may be controllable via an on screen game menu. The EGM 10 is configurable to provide full control over all built-in functionality (lights, frame lights, sounds, and so on).

EGM 10 may also include a plurality of effects lights and frame lights. The lights may be synchronized with enhancements of the game. The EGM 10 may be configured to control color and brightness of lights. Additional custom animations (color cycle, blinking, etc.) may also be configured by EGM 10. The custom animations may be triggered by certain gaming events.

Figure 2A:
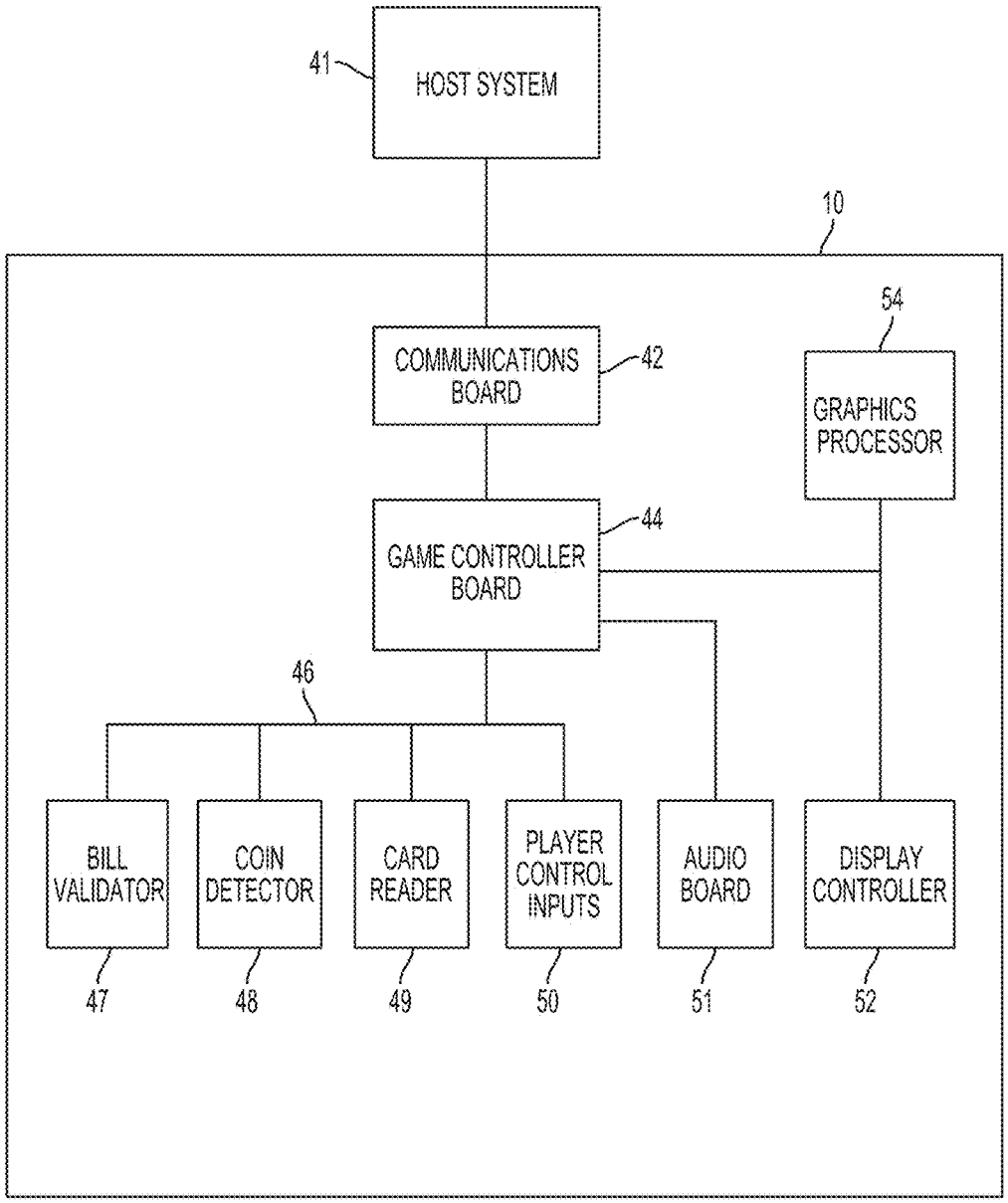
FIG. 2*a* is a schematic diagram of an electronic gaming machine linked to a casino host system according to some embodiments.

FIG. 2*a* is a block diagram of hardware components of EGM 10 according to some embodiments. EGM 10 is shown linked to the casino's host system 41 via network infrastructure. These hardware components particularly configured to provide games with interactive bonus game enhancements. The host system 41 may manage player accounts based on game activity and prizes or awards from interactive games.

A communications board 42 may contain circuitry for coupling the EGM 10 to network. Communication board 42 may include a network interface allowing EGM 10 to communicate with other components, to access and connect to network resources, to serve an application, to access other applications, and to perform other computing applications by connecting to a network (or multiple networks) capable of carrying data including the Internet, Ethernet, plain old telephone service (POTS) line, public switch telephone network (PSTN), integrated services digital network (ISDN), digital subscriber line (DSL), coaxial cable, fiber optics, satellite, mobile, wireless (e.g. WMAX), SS7 signaling network, fixed line, local area network, wide area network, and others, including any combination of these. EGM 10 may communicate over a network using a suitable protocol, such as the G2S protocols.

Communications board 42 communicates, transmits and receives data using a wireless transmitter, or it may be wired to a network, such as a local area network running throughout the casino floor, for example. Communications board 42 may set up a communication link with a master controller and may buffer data between the network and game controller board 44. Communications board 42 may also communicate with a network server, such as in accordance with the G2S standard, for exchanging information to carry out embodiments described herein.

Game controller board 44 includes memory and a processor for carrying out program instructions stored in the memory and for providing the information requested by the network. Game controller board 44 executes game routines using game data stores in a data store accessible to the game controller board 44, and cooperates with graphics processor 54 and display controller 52 to provide games with enhanced interactive game components.

Peripheral devices/boards communicate with the game controller board 44 via a bus 46 using, for example, an RS-232 interface. Such peripherals may include a bill validator 47, a coin detector 48, a smart card reader or other type of card reader 49, and player control inputs 50 (such as buttons or a touch screen). Card reader 49 may function as described in relation to card reader 34 of FIG. 1, for example.

Player input device 50 may include the keypad, the buttons, touchscreen display, gesture tracking hardware, data capture device as described herein. Other peripherals may be one or more cameras used for collecting player input data, or other player movement or gesture data that may be used to trigger player interaction commands. Player input device 50 may be integrated with touch screen display 12, 14 to detect player interaction input commands at the touch screen display 12, 14.

Game controller board 44 may also control one or more devices that produce the game output including audio and video output associated with a particular game that is presented to the user. For example, audio board 51 may convert coded signals into analog signals for driving speakers.

Game controller board 44 may be coupled to an electronic data store storing game data for one or more games. The game data may, for example, include a set of game instructions for each of the one or more games. The electronic data store may reside in a data storage device, e.g., a hard disk drive, a solid state drive, or the like. Such a data storage device may be included in EGM 10, or may reside at host system 41. In some embodiments, the electronic data store storing game data may reside in the cloud.

Card reader 49 reads cards for player and credit information for cashless gaming. Card reader 49 may read a magnetic code on a player tracking card, where the code uniquely identifies the player to a host system at the venue. The code is cross-referenced by host system 41 to any data related to the player, and such data may affect the games offered to the player by the gaming terminal. Card reader 49 may also include an optical reader and printer for reading and printing coded barcodes and other information on a paper ticket. A card may also include credentials that enable the host system to access one or more accounts associated with a user. The account may be debited based on wagers by a user and credited based on a win. The account may be managed by host system which may manage multiple user accounts. Each account may be linked to a user via an identification token, and the like. Card reader 49 may read from various types of cards, such as smart cards, magnetic strip cards, device tokens, or other types of cards conveying machine readable information.

Card reader 49 may be implemented in different ways for various embodiments. Card reader 49 may be an electronic reading device such as a player tracking card reader, a ticket reader, a banknote detector, a coin detector, and any other input device that can read an instrument supplied by the player for conveying a monetary amount. In the case of a tracking card, card reader 49 detects the player's stored bank and applies that to the gaming machine being played. Card reader 49 or reading device may be an optical reader, a magnetic reader, or other type of reader. Card reader 49 may have a slot provided in the gaming machine for receiving the instrument. Card reader 49 may also have a communication interface (or control or connect to a communication interface) to digitally transfer tokens or indicia of credits or money via various methods such as RFID, tap, smart card, credit card, loyalty card, NFC and so on.

An electronic device may couple (by way of a wired or wireless connection, card reader 49, or another hardware component) to the EGM 10 to transfer electronic data signals for player credits and the like. For example, near field communication (NFC) may be used to couple to EGM 10 which may be configured with NFC enabled hardware. This is a non-limiting example of a communication technique.

Graphics processor 54 may be configured to generate and render animation game enhancements based on game data as directed by game controller board 44. The game enhancements involve an interactive game environment with graphical animation effects. The graphics processor 54 may be a specialized electronic circuit designed for image processing (including 3D image processing in some examples) in order to manipulate and transform data stored in memory to accelerate the creation of images in a frame buffer for output to the display by way of display controller 52. The graphics processor 54 may redraw various game enhancements as they dynamically update. The graphics processor 54 may cooperate with game controller board and display controller 52 to generate and render enhancements as described herein. The graphics processor 54 generates an interactive game environment that provides a prize selection game zone with prize selector game symbols visible at different prize locations within the interactive game environment. The graphics processor 54 generate animations effects to represent movement of a pointer to different positions within the interactive game environment in response to unmasked game symbols. In operation, the animation moves the pointer relative to the prize selector symbols.

Display controller 52 may require a high data transfer rate and may convert coded signals to pixel signals for the display. Display controller 52 and audio board 51 may be directly connected to parallel ports on the game controller board 44. The electronics on the various boards may be combined onto a single board. Display controller 52 controls output to one or more displays 12, 14 (e.g. an electronic touch sensitive gaming display device). Display controller cooperates with graphics processor 54 to render animation enhancements on display 12, 14.

Display controller 52 may be configured to interact with graphics processor 54 to control the display 12, 14 to display a view window defining the interactive game environment including navigation to different views of the interactive game environment. Player input device 50 continuously detects, at the display 12, 14, player interaction commands to select and reveal masked prize selector game symbols.

In response to selected game symbols, display controller 52 controls the display 12, 14 using the graphics processor 54 to trigger graphical animation effect representing movement of the pointer to different positions.

Display controller 52 generates movement animations of the pointer to different positions to point to different prize symbols. Player selection of one or more prize selector symbols may result in a winning gaming outcome and an enhanced game experience for the user. Display controller 52 interacts with EGM 10 for mapping of the pointer positions relative to the prize selector symbols to define movement(s) for animation effect.

Host system 41 may store account data for players. EGM 10 may communicate with host system 41 to update such account data, for example, based on wins and losses. In an embodiment, host system 41 stores the aforementioned game data, and EGM 10 may retrieve such game data from host system 41 during operation.

In some embodiments, the electronics on the various boards described herein may be combined onto a single board. Similarly, in some embodiments, the electronics on the various controllers and processors described herein may be integrated. For example, the processor of game controller board 44 and graphics processor 54 may be a single integrated chip.

EGM 10 may be configured to provide interactive bonus game enhancements to one or more games playable at EGM 10. The enhancements may be to a primary game, secondary game, bonus game, or combination thereof.

Figure 2B:
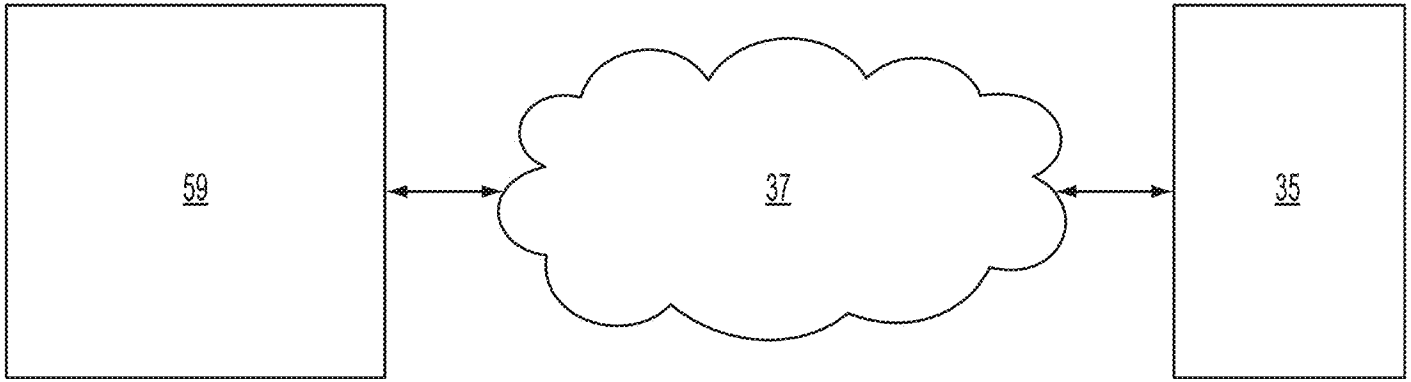
FIG. 2*b* is a schematic diagram of an exemplary online implementation of a computer system and online gaming system according to some embodiments.

FIG. 2*b* illustrates an online implementation of a gaming system that provides interactive bonus game enhancements with an interactive environment as described herein. The gaming system may be an online gaming device (which may be an example implementation of an EGM) in accordance with the interactive bonus game enhancements. As depicted, the gaming system includes a server computer 35 and a gaming device 59 connected via network 37.

In some embodiments, gaming server 35 and gaming device 59 cooperate to implement the functionality of EGM 10, described above. So, aspects and technical features of EGM 10 may be implemented in part at gaming device 59, and in part at gaming server 35.

Gaming server 35 may be configured to enable online gaming, and may include game data and game logic to implement the games and enhancements disclosed herein. For example, gaming server 35 may include a player input engine configured to process player input and respond according to game rules. Gaming server 35 may include a graphics engine configured to generate the interactive game environment as disclosed herein. In some embodiments, gaming server may provide rendering instructions and graphics data to gaming device 59 so that graphics may be rendered at gaming device 39.

Gaming server 35 may also include a movement recognition engine that may be used to process and interpret collected player movement data, to transform the data into data defining manipulations and player interaction commands.

Network 37 may be any network (or multiple networks) capable of carrying data including the Internet, Ethernet, POTS line, PSTN, ISDN, DSL, coaxial cable, fiber optics, satellite, mobile, wireless (e.g. WMAX), SS7 signaling network, fixed line, local area network, wide area network, and others, including any combination of these.

Gaming device 35 may be particularly configured with hardware and software to interact with gaming server 59 via network 37 to implement gaming functionality and render 3D enhancements, as described herein. For simplicity only one gaming device 35 is shown but an electronic gaming system may include one or more gaming devices 35 operable by different players. Gaming device 35 may be implemented using one or more processors and one or more data stores configured with database(s) or file system(s), or using multiple devices or groups of storage devices distributed over a wide geographic area and connected via a network (which may be referred to as "cloud computing"). Aspects and technical features or EGM 10 may be implemented using gaming device 35.

Gaming device 35 may reside on any networked computing device, such as a personal computer, workstation, server, portable computer, mobile device, personal digital assistant, laptop, tablet, smart phone, an interactive television, video display terminals, gaming consoles, electronic reading device, and portable electronic devices or a combination of these.

Gaming device 35 may include any type of processor, such as, for example, any type of general-purpose microprocessor or microcontroller, a digital signal processing (DSP) processor, an integrated circuit, a field programmable gate array (FPGA), a reconfigurable processor, a programmable read-only memory (PROM), or any combination thereof. Gaming device 35 may include any type of computer memory that is located either internally or externally such as, for example, random-access memory (RAM), read-only memory (ROM), compact disc read-only memory (CDROM), electro-optical memory, magneto-optical memory, erasable programmable read-only memory (EPROM), and electrically-erasable programmable read-only memory (EEPROM), Ferroelectric RAM (FRAM) or the like.

Gaming device 35 is operable to register and authenticate users (using a login, unique identifier, and password for example) prior to providing access to applications, a local network, network resources, other networks and network security devices. Computing device 30 may serve one user or multiple users.

Gaming device 35 may include one or more input devices (e.g. player input device 50), such as a keyboard, mouse, camera, touch screen and a microphone, and may also include one or more output devices such as a display screen (with 3D capabilities) and a speaker. Gaming device 35 has a network interface in order to communicate with other components, to access and connect to network resources, to serve an application and other applications, and perform other computing applications.

Gaming device 35 connects to gaming server 39 by way of network 37 to access technical 3D enhancements to games as described herein. Multiple gaming devices 35 may connect to gaming server 39, each gaming device 35 operated by a respective player.

Figure 2C:
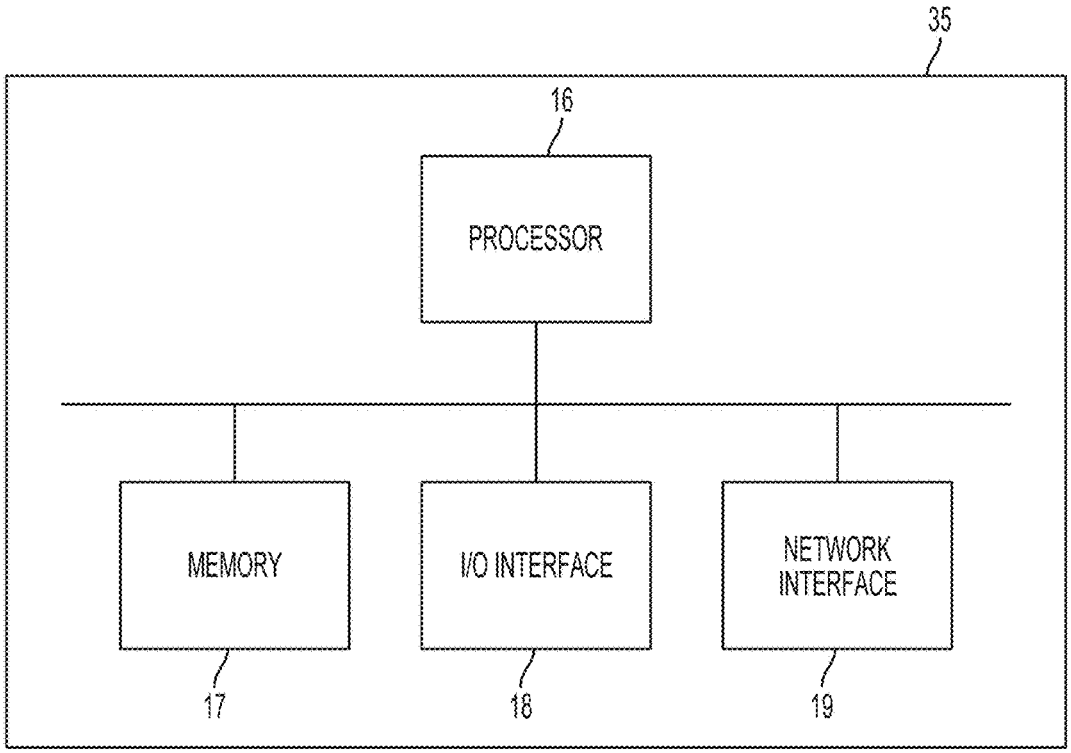
FIG. 2*c* is a schematic diagram of the computer system of FIG. 2*b* according to some embodiments.

FIG. 2C is a block diagram depicting hardware components of a gaming device 35, exemplary of an embodiment.

As depicted, gaming device 35 includes at least one processor 16, memory or data store 17, at least one I/O interface 18, and at least one network interface 19.

Processor 16 may be any type of processor, such as, for example, any type of general-purpose microprocessor or microcontroller, a DSP processor, an integrated circuit, an FPGA, a reconfigurable processor, a PROM, or any combination thereof. Processor 16 may also be a graphics processor adapted to generate and render graphic animations effects, as described above.

Memory 17 may be any type of electronic memory that is located either internally or externally such as, for example, RAM, ROM, CDROM, electro-optical memory, magneto-optical memory, EPROM, and EEPROM, FRAM or the like.

I/O interfaces 18 enables gaming device 35 to interconnect with input and output devices, e.g., peripheral devices or external storage devices. Such peripheral devices may include one or more input devices, such as a keyboard, mouse, camera, touch screen and a microphone, and may also include one or more output devices such as a display screen (with three dimensional capabilities) and a speaker.

Network interfaces 19 enable gaming device 35 to communicate with other networks, to access and connect to network resources, to serve an application, to access other applications, and perform other computing applications by connecting to a network such as network 37.

In an embodiment, gaming server 59 may include hardware components similar to those shown in FIG. 2C.

In an embodiment, gaming device 35 and/or gaming server 59 may be implemented using multiple devices, multiple databases, or multiple storage devices distributed over a wide geographic area and connected via a network (which may be referred to as "cloud computing"). In an embodiment, EGM 10 and gaming server 39 may be integrated as a single system or a single device.

Figure 2D:
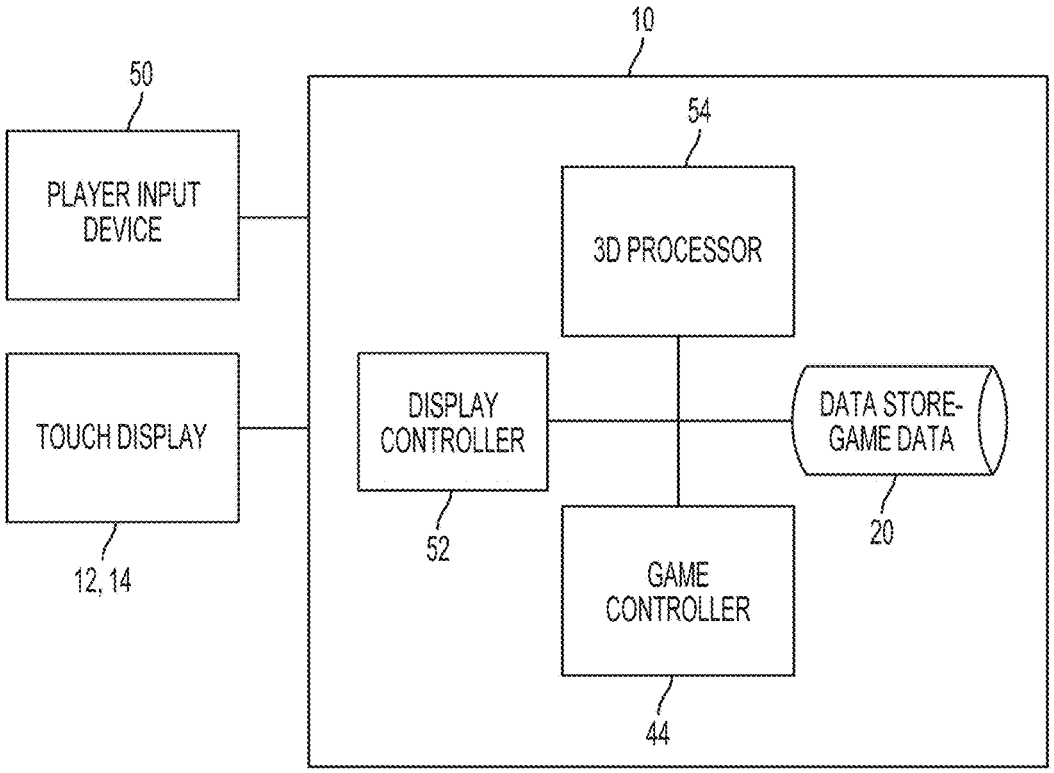
FIG. 2*d* is a schematic diagram of an exemplary electronic gaming machine according to some embodiments.

FIG. 2D is a schematic of another example EGM 10 according to some embodiments. Various components of EGM 10 shown in this example are described herein in relation to FIGS. 1 and 2B. As shown, EGM 10 may couple to player input device 50 (which may also include a card reader) and touch display 12, 14 to render the interactive game environment and receive player interactive control commands. EGM 10 may also include a display controller 52 and 3D graphics processor 54 to control graphical animation effects rendered on touch display 12, 14 in response to the interactive control commands. EGM 10 may also include a game controller 44 and data storage 20 for storing game data and mapping between pointer positions relative to prize selector symbols.

Figure 3:
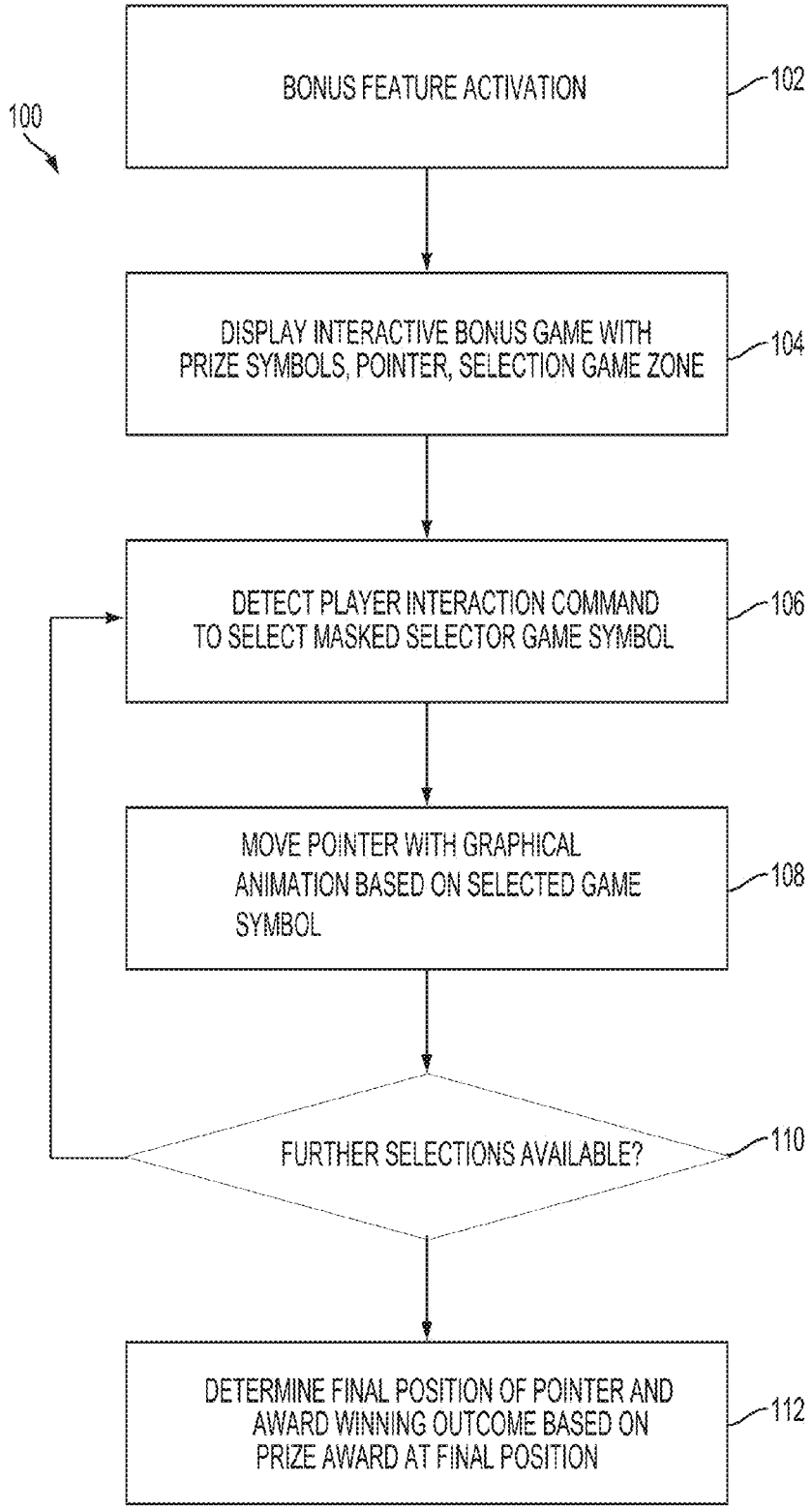
FIG. 3 is a flowchart diagram of a method for a gaming machine according to some embodiments.

FIG. 3 is a flowchart of a method 100 implemented by EGM 10 using various components of EGM 10. For simplicity of illustration, method 100 will be described with reference to FIG. 2D and EGM 10 but it may be implement using gaming device 35, game server 39 or a combination thereof.

As shown, EGM 10 may include at least one data store device 20 storing game data for an interactive bonus game. EGM 10 may include a game controller 44 for detecting game activation and controlling the game in accordance with a set of game data. Card reader 34, 49 may also be used for game activation and wagering. The game controller 44 is configured to receive wagers for gaming outcomes, and determine gaming outcomes. A gaming outcome involves a selection of prize selector game symbol(s), movement of the pointer to various positions. The award corresponds to the prize symbol the pointer points at in its final position. The game controller 44 is configured to determine a winning game outcome and generate signals for distributing an award based on the winning game outcome. The award may be distributed using the card reader 34, 49 for example.

EGM 10 includes an electronic 3D enabled touch sensitive gaming display device 12, 14. EGM 10 may include a 3D graphics processor 54 to generate an interactive bonus game environment as described. The interactive bonus environment provides a selection game zone with masked or covered selector game symbols visible at different locations within the interactive bonus environment.

At 102 (FIG. 3), game controller 54 triggers bonus feature activation and controls the interactive bonus game. The game controller 54 may trigger bonus feature activation from an event in a base or primary game. The trigger may be dynamically updated based on game events or player activity data. The trigger may be configured using host system 41, for example.

Figure 5:
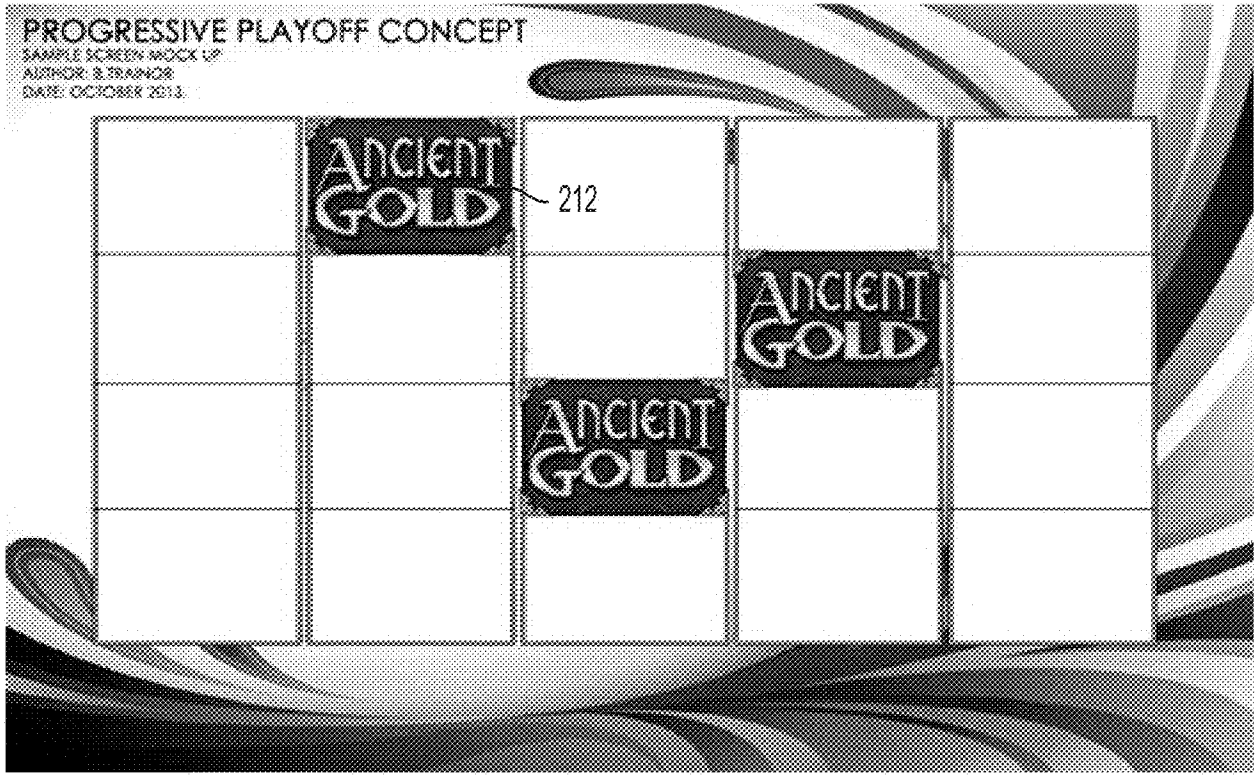

An example interface screen for a base or primary game is shown in FIG. 5. The bonus feature functionality may be triggered from a base game related to a 5×4 reel product in this example. As an illustrative embodiment, the bonus feature may be triggered by 3, 4, or 5 symbols 212 landing on the base game screen within a wagered spin. In some embodiments, the higher the number of trigger symbols 212 onscreen for the base game that initiated the bonus, the higher the number of picks or selections the player will receive during the interactive bonus game.

At 104 (FIG. 3), display controller 52 controls the electronic enabled touch sensitive gaming display device 12, 14 using the graphics processor 54 to display the interactive bonus game environment.

Figure 4:
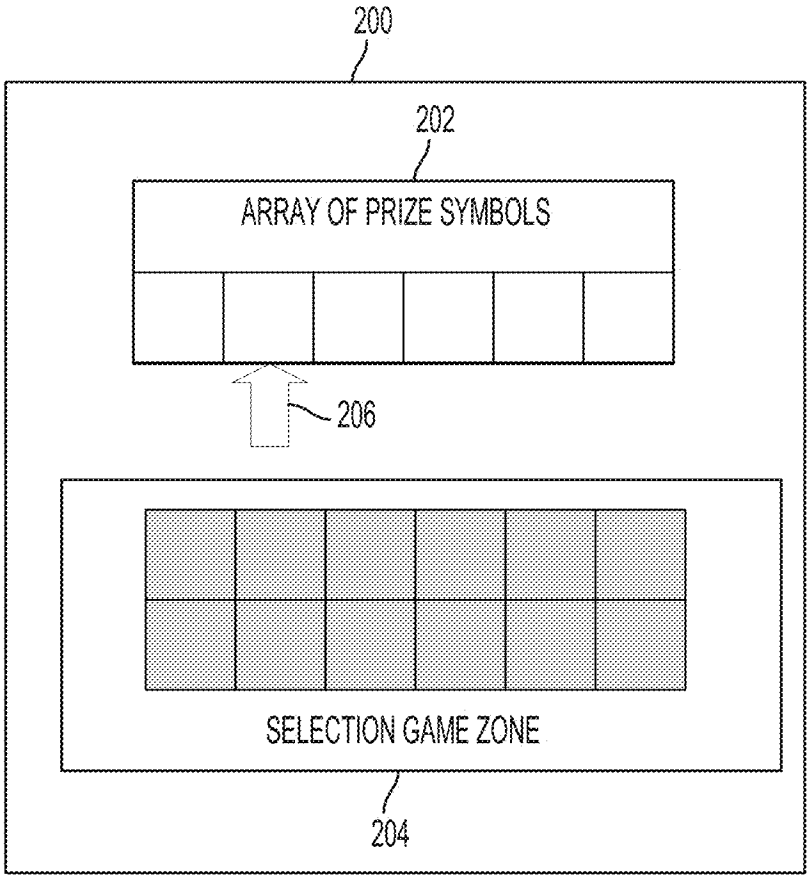
FIGS. 4 to 10 are schematics diagrams of example game display interfaces according to some embodiments.

FIG. 4 illustrates a schematic diagram of an example interactive bonus game environment 200. The initial view window presents the player with an array of prize symbols 202, a pointer 206, and a selection game zone 204 with masked or covered selector game symbols. The initial view window may be a default portion of the prize selection zone of the interactive game environment, and the view window may update to reveal different portions of the prize selection zone. This is an example configuration for illustration. The pointer 206 may have different shape and form in other example embodiments. EGM 10 maintains a mapping of the pointer 206 relative to the array of prize symbols 202 to define the movement.

The selection game zone 204 may be divided into subsections in different locations within the interactive bonus game environment 200. Although the interactive bonus game environment 200 is shown rectangular it may be of different shape such as circular or elliptical for example. The interactive bonus game environment 200 may be 2D or 3D for example. The array of prize symbols 202 is shown rectangular but may also be of other shapes such as circular or elliptical, for example, and the prize symbols may have different arrangements. The prize symbols or selector game symbols may or may not be in direct contact depending on the visual display configuration.

Figure 6:
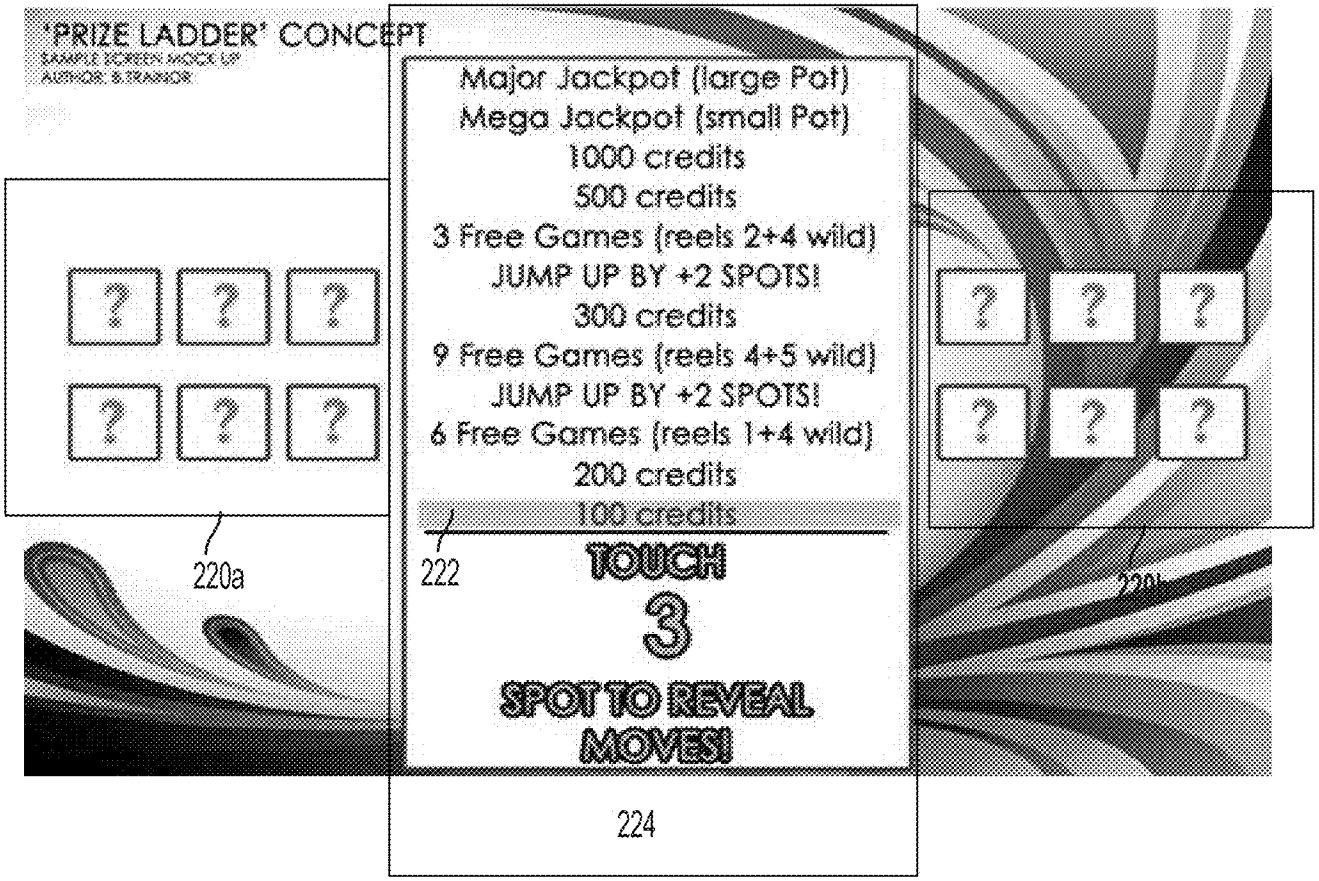

FIG. 6 illustrates another schematic diagram of an example interactive bonus game environment. The view window presents the player with an array of prize symbols 224, a pointer 222 to highlight or otherwise indicate a (current) prize symbol, and selection game zones 220*a*, 220*b* with masked or covered selector game symbols. The illustrative example array of prize symbols 224 may be represented as a ladder and the interactive bonus game may have a pick-a-prize ladder feature. A limited number of masked or covered selector game symbols may be selected to trigger graphical animations representing movement of the pointer 222 to different prize symbols on the ladder 224. The movement of the pointer 222 is defined by the selected revealed game symbols. EGM 10 maintains a mapping of the pointer 222 relative to the array of prize symbols 224 to define the movement.

When entering into the bonus feature, the player may be presented with an interactive bonus game pick screen or selection game zone 220*a*, 220*b*, and a ladder of prizes 224. In this example, the prizes may be arranged on the ladder in the order of highest prize at the top and smallest prize at the bottom. Other arrangements are possible and this is an illustrative example. The prizes may be ordered or randomly arranged. There pointer 22 has an initial position or a starting point at which the player will be awarded at minimum the prize that is displayed at the bottom of the ladder 224.

In this example, included in the ladder 224 of prizes there is shown two bonus jackpots available to be won from within the bonus feature (e.g. major jackpot, mega jackpot). In this example, the amount contributed to the prize jackpots may be based on the percentage of the amount of wagering unit played per wagered game. There may also be static prizes displayed on the top screen in the ladder 224 along with the two pots.

Players may be prompted to touch the display screen to make a limited number of selections of masked or covered selector game symbols in the selection game zone 220*a*, 220*b*. The limit may be dynamic based on various factors, including a trigger mechanism or event of the base game, the amount of a wager, the player, the location, the time, the type of bonus game, the total number of selector game symbols, and so on. The selections may be made incrementally (e.g., selection, movement of the pointer, selection, movement of the pointer). For example, the limited number may be 3, 4, or 5 icons from the spots onscreen in the interactive selection game zone 220*a*, 220*b* area. The limited number of available selections may be dynamic varying based on game factors.

In the interactive area, the game symbols may contain 3 different movement description items: move up, move down, or start symbols. These are actions may be applied to the pointer on the ladder to define its movement. The mapping of the pointer relative to the game symbols may also be used to define the movement.

At 106, the player input device continuously detects, at the touch sensitive display device, player interaction commands to select the selector game symbols. The game symbols define movement for the pointer relative to the prize symbols of the array. The number of player selections may be limited based on a trigger mechanism or game event as described herein.

At 108, in response to detection by the player input device of a player interaction command, a display controller triggers a graphical animation effect on the display device representative of movement of the pointer relative to the prize symbols of the array. The movement is based on the revealed game symbol based on the selections. Multiple player interaction commands may trigger multiple animation effects and movements of the pointer relative to the game symbols.

The pointer 222 on the prize ladder 224 may move (via animation) after each selection based on the movement defined by the revealed game symbol. That is, the pointer 222 may move as the player touches spots on the display screen that correspond or map to locations of selector game symbols. Selections may be consolidated to define a continuous or a path of movement of the pointer 222 in some example embodiments.

Figure 7:
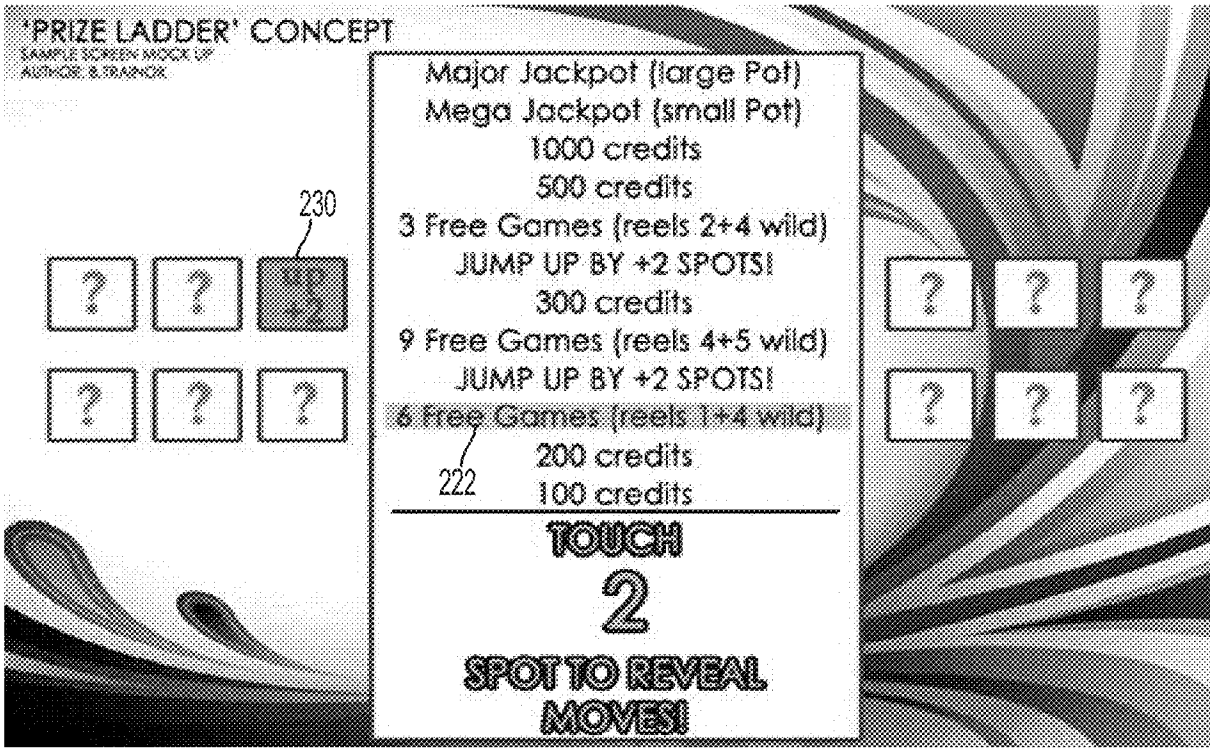

FIG. 7 shows an example schematic with a selected game symbol 230. In response, the pointer 222 moves to an updated position on the ladder. The movements may be side to side, or up and down or rotation, diagonal, for example. Possible prize selector symbols may be located all around an interactive environment with a possibility of other interactive elements such as portals, animated game symbols and so on. The interactive game environment creates an engaging pick-a-prize type game experience for the player. Player request interactive input allow the player to control movements within the interactive 3D environment using interactive touch input.

Figure 8:
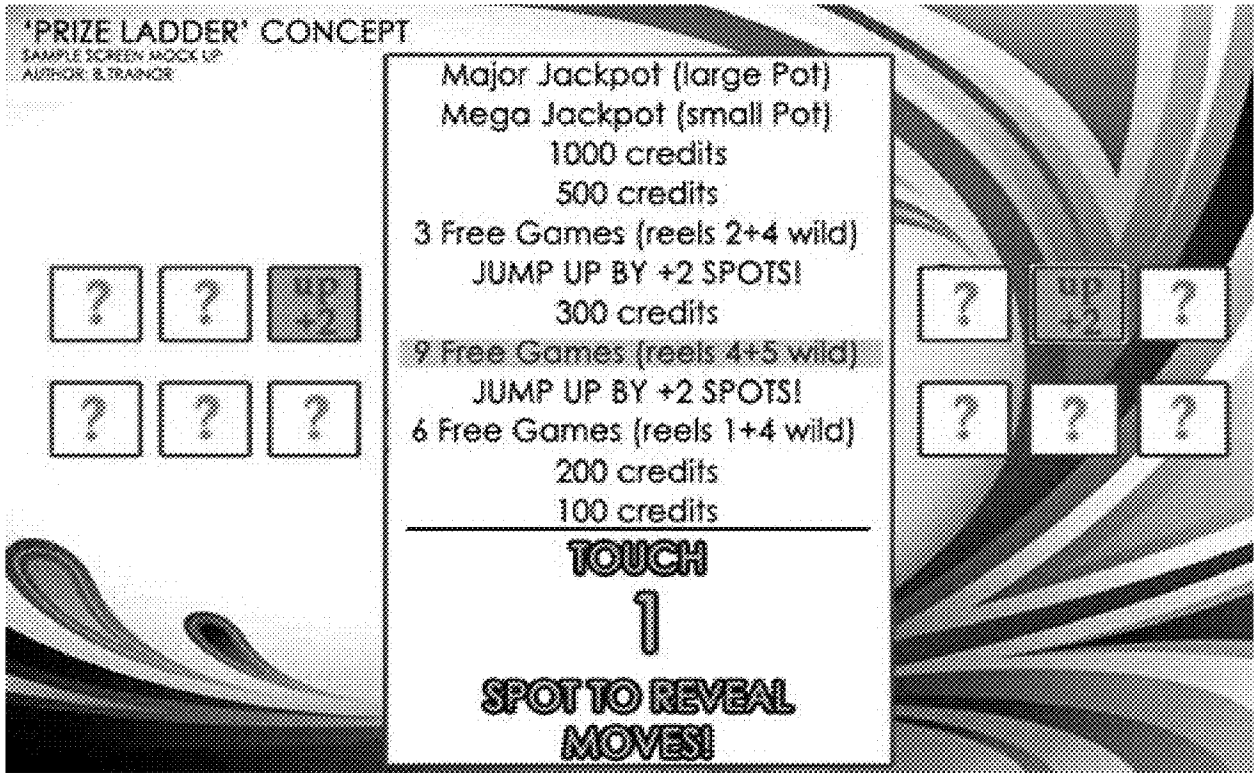
Figure 9:
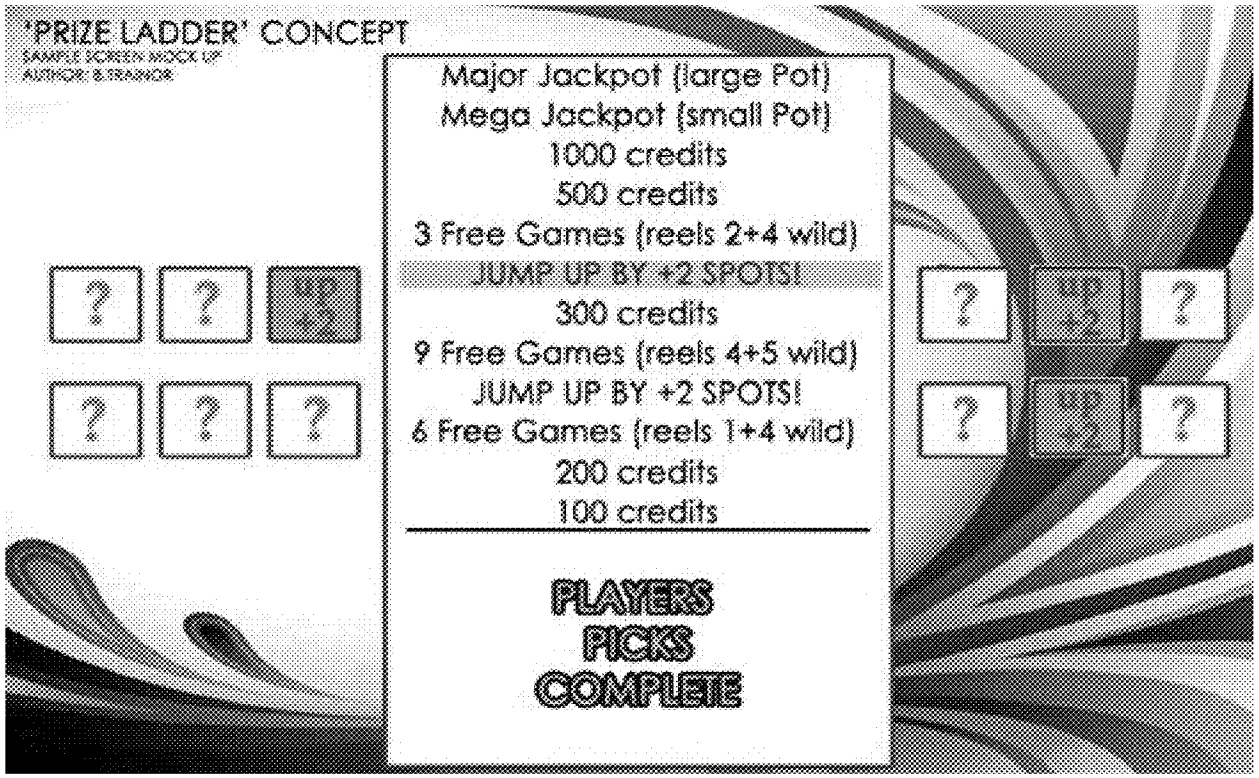

At 110, the game controller determines whether there are further selections available. If so, additional masked or covered game symbols may be selected by player interaction commands. Additional selections may be made to reveal additional game symbols up to a defined limit. The defined limit may be dynamic based on various factors, including a trigger mechanism or event of the base game, the amount of a wager, the player, and so on. A FIGS. 8 and 9 show example schematic with additional selected game symbols which in turn trigger movement of the pointer 222 to updated positions on the ladder.

At 112, the game controller determines a final position for the pointer relative to the prize symbols. The final position triggers a winning outcome of the game for provision of an award based on the prize symbol indicated in the final position. The card reader 34, 49 may be used to transfer the award or prize to a token of the user.

After the final pick or selection has been made (as defined by the limited number of available selections), the pointer 222 will update to its final position and indicate the bonus event or award the player has been awarded (credits, free games, or bonus pot).

Figure 10:
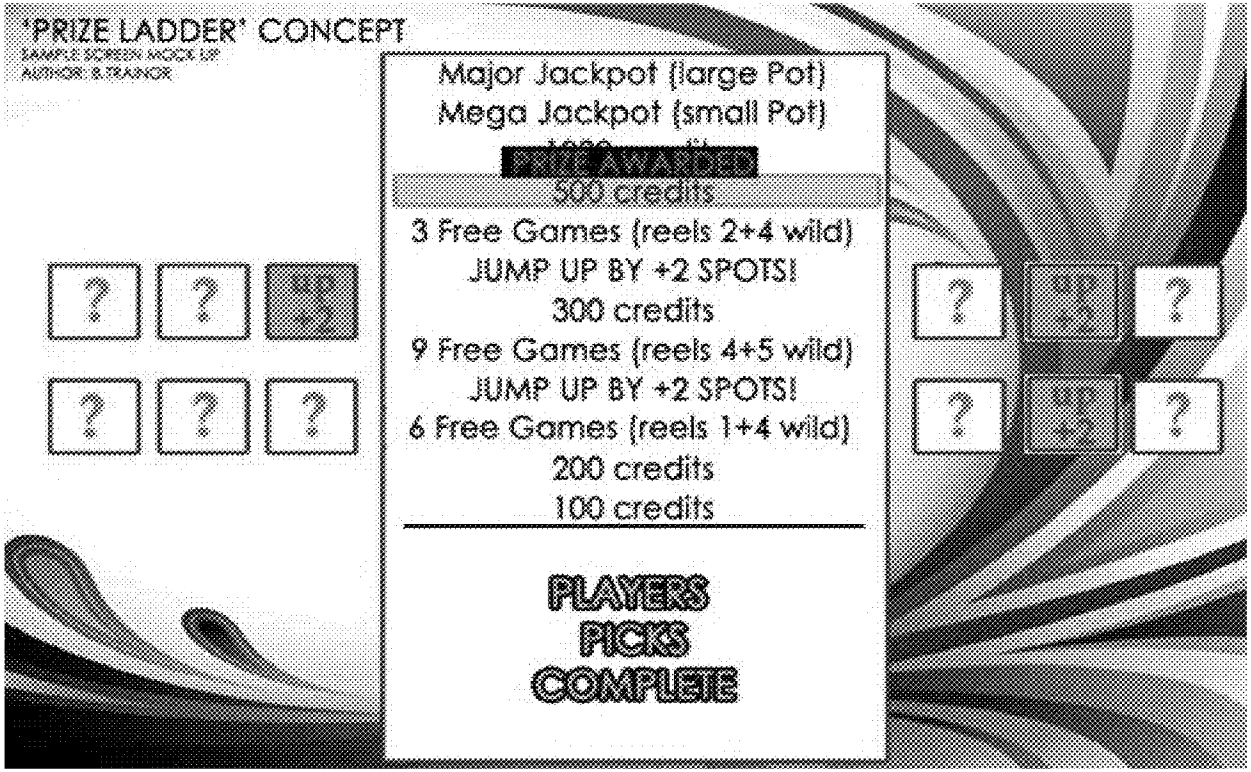

FIG. 10 shows an example schematic with additional selected game symbols which in turn trigger movement of the pointer 222 to the final position on the ladder. The final position indicates the prize award.

The display controller 52 may control the display 12, 14 to provide visual animations for movement of the pointer which will indicate to the player the awarded prize.

Visual cues provide guidance for the player for the selector game symbols. Examples of visual cues include prompts, animations, arrows, and so on. The pointer position may be updated by rotation movement, an upward movement, a downward movement, a left movement, a right movement, and so on.

The interactive game environment may be a 180 degree wrap around environment or a 360 degree wrap around environment or other variations. The shape of the interactive game environment 202 may vary such as a cube or cylinder or other sided shape, dimensional representation.

An example may be a touch input with a swipe in a direction or a particular touch gesture. Player request interaction input defines an update action to navigate to a different portion of the interactive 3D game environment to reveal prize selector game symbols. Other example player request interaction input include gestures or body movements.

In response to detection of each player request interaction input, display controller 52 continuously controls the electronic gaming display device 12, 14 using the graphics processor 54 to update the view window to move pointer to new positions within the interactive game environment.

The display controller 52 may use a mapping between touch locations and an interactive game environment 242 at the cell level to track location of various selector game symbols. The mapping may use coordinates, cell locations, or anchors to link the touch locations and the selector game symbols.

The updated position may involve movement in at least one direction of up, down, left, right, and diagonal. Gesture recognition with various sensors may also be used for selection.

The embodiments of the devices, systems and methods described herein may be implemented in a combination of both hardware and software. These embodiments may be implemented on programmable computers, each computer including at least one processor, a data storage system (including volatile memory or non-volatile memory or other data storage elements or a combination thereof), and at least one communication interface.

Program code is applied to input data to perform the functions described herein and to generate output information. The output information is applied to one or more output devices. In some embodiments, the communication interface may be a network communication interface. In embodiments in which elements may be combined, the communication interface may be a software communication interface, such as those for inter-process communication. In still other embodiments, there may be a combination of communication interfaces implemented as hardware, software, and combination thereof.

Throughout the following discussion, numerous references will be made regarding servers, services, interfaces, portals, platforms, or other systems formed from computing devices. It should be appreciated that the use of such terms is deemed to represent one or more computing devices having at least one processor configured to execute software instructions stored on a computer readable tangible, non-transitory medium. For example, a server can include one or more computers operating as a web server, database server, or other type of computer server in a manner to fulfill described roles, responsibilities, or functions.

One should appreciate that the systems and methods described herein may [note to draftsperson: consider describing example technical effects and solutions e.g. better memory usage, improved processing, improved bandwidth usage].

The following discussion provides many example embodiments. Although each embodiment represents a single combination of inventive elements, other examples may include all possible combinations of the disclosed elements. Thus if one embodiment comprises elements A, B, and C, and a second embodiment comprises elements B and D, other remaining combinations of A, B, C, or D, may also be used.

The term "connected" or "coupled to" may include both direct coupling (in which two elements that are coupled to each other contact each other) and indirect coupling (in which at least one additional element is located between the two elements).

Embodiments described herein may be implemented by using hardware only or by using software and a necessary universal hardware platform. Based on such understandings, the technical solution of embodiments may be in the form of a software product. The software product may be stored in a non-volatile or non-transitory storage medium, which can be a compact disk read-only memory (CD-ROM), USB flash disk, or a removable hard disk. The software product includes a number of instructions that enable a computer device (personal computer, server, or network device) to execute the methods provided by the embodiments.

The embodiments described herein are implemented by physical computer hardware. The embodiments described herein provide useful physical machines and particularly configured computer hardware arrangements. The embodiments described herein are directed to electronic machines methods implemented by electronic machines adapted for processing and transforming electromagnetic signals which represent various types of information. The embodiments described herein pervasively and integrally relate to machines, and their uses; and the embodiments described herein have no meaning or practical applicability outside their use with computer hardware, machines, a various hardware components. Substituting the computing devices, servers, receivers, transmitters, processors, memory, display, networks particularly configured to implement various acts for non-physical hardware, using mental steps for example, may substantially affect the way the embodiments work. Such computer hardware limitations are clearly essential elements of the embodiments described herein, and they cannot be omitted or substituted for mental means without having a material effect on the operation and structure of the embodiments described herein. The computer hardware is essential to the embodiments described herein and is not merely used to perform steps expeditiously and in an efficient manner.

For example, and without limitation, the computing device may be a server, network appliance, set-top box, embedded device, computer expansion module, personal computer, laptop, personal data assistant, cellular telephone, smartphone device, UMPC tablets, video display terminal, gaming console, electronic reading device, and wireless hypermedia device or any other computing device capable of being configured to carry out the methods described herein.

Although the embodiments have been described in detail, it should be understood that various changes, substitutions and alterations can be made herein without departing from the scope as defined by the appended claims.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized. Accordingly, the appended claims are intended to include within their scope such processes, machines, manufacture, compositions of matter, means, methods, or steps.

As can be understood, the examples described above and illustrated are intended to be exemplary only.

What is claimed is:

1. An electronic gaming machine comprising:

a card reader to identify a monetary amount conveyed to the electronic gaming machine;

at least one data storage device to store game data for an interactive bonus game;

a game controller for detecting bonus feature activation and controlling the interactive bonus game;

a touch sensitive display device configured to provide an interactive game environment with an array of prize symbols, a pointer, and a selection game zone comprising a plurality of masked or covered selector game symbols;

a player input device to continuously detect, at the touch sensitive display device, player interaction commands to select at least one of the selector game symbols to move the pointer relative to the prize symbols of the array, the player selections being limited for a number of selections operational when the interactive bonus game starts due to a trigger mechanism determining the limit;

wherein, in response to detection by the player input device of a player interaction command, a display controller triggers a graphical animation effect displayed on the display device representative of movement of the pointer relative to the prize symbols of the array to an updated position to trigger a winning outcome of the game for provision of an award based on the prize symbol indicated in the updated position, the game controller maintaining a mapping between the pointer and the prize symbols of the array to define the movement;

wherein the card reader updates the monetary amount for the award, and wherein a limit of selections is based on a number of game symbols appearing in a base game such that the higher the number of game symbols appearing the higher the limit of selections.

2. The machine of claim 1, wherein the selector game symbols are directional symbols indicating direction of movement of the pointer.

3. The machine of claim 1, wherein the selector game symbols are masked or covered and revealed once selected.

4. The machine of claim 1, wherein at least one sequence of selections of the selector game symbols providing the winning outcome.

5. The machine of claim 1, wherein the award is based on the prize symbol that the pointer points at in a final position including credits, free games, mega pot, small pot, and/or progressive pot.

6. The machine of claim 1, wherein a trigger mechanism for the interactive bonus game is based on the number of symbols appearing in the base game.

7. The machine of claim 1, wherein the array of prize symbols is a ladder of prizes where a starting point for the pointer is a minimum prize on the ladder.

8. The machine of claim 1, wherein after a final selection is made the updated position of the pointer is a final position that points to a prize symbol that reveals a prize for the winning outcome.

9. An electronic gaming machine comprising:

a card reader to identify a monetary amount conveyed to the electronic gaming machine;

at least one data storage device to store game data for an interactive bonus game;

a game controller for detecting bonus feature activation and controlling the interactive bonus game;

a display device configured to display an interactive game environment with an array of prize symbols, a pointer, and a selection game zone comprising a plurality of masked or covered selector game symbols;

a player input device to detect, at the display device, player interaction commands to select selector game symbols that define and trigger movement of the pointer relative to the prize symbols of the array to a plurality of positions, the player selections being limited for a number of selections operational when the bonus game starts due to a trigger mechanism determining the limit;

wherein, in response to detection by the player input device of a player interaction command, a display controller triggers a graphical animation effect displayed on the display device representative of movement of the pointer relative to the prize symbols of the array to the plurality of positions to trigger a winning outcome of the game for provision of an award based on the prize symbol indicated in a final position;

wherein the card reader updates the monetary amount for the award, and wherein a limit of selections is based on a number of game symbols appearing in a base game such that the higher the number of game symbols appearing the higher the limit of selections.

10. The machine of claim 9, wherein the selector game symbols are directional symbols indicating direction of movement of the pointer.

11. The machine of claim 9, wherein the selector game symbols are masked or covered and revealed once selected.

12. The machine of claim 9, wherein at least one sequence of selections of the selector game symbols providing the winning outcome.

13. The machine of claim 9, wherein the award is based on the prize symbol that the pointer points at in a final position including credits, free games, mega pot, small pot, and/or progressive pot.

14. The machine of claim 9, wherein a trigger mechanism for the interactive bonus game is based on a number of symbols appearing in a base game.

15. The machine of claim 9, wherein the array of prize symbols is a ladder of prizes where a starting point for the pointer is a minimum prize on the ladder.

16. The machine of claim 9, wherein after a final selection is made the updated position of the pointer is a final position that points to a prize symbol that reveals a prize for the winning outcome.

17. An electronic gaming machine comprising:

at least one data storage device to store game data for an interactive bonus game;

a game controller for detecting bonus feature activation and controlling the interactive bonus game;

a touch sensitive display device configured to provide an interactive game environment with an array of prize symbols, a pointer, and a selection game zone comprising a plurality of masked or covered selector game symbols;

a player input device to continuously detect, at the touch sensitive display device, player interaction commands to select at least one of the selector game symbols to move the pointer relative to the prize symbols of the array, the player selections being limited for a number of selections operational when the interactive bonus game starts due to a trigger mechanism determining the limit;

wherein, in response to detection by the player input device of a player interaction command, a display controller triggers a graphical animation effect displayed on the display device representative of a plurality of movements of the pointer relative to the prize symbols of the array to updated positions to trigger a winning outcome of the game for provision of an award based on the prize symbol indicated in the updated position; and wherein after a final selection is made the pointer is at a final position that points to a prize symbol that reveals a prize for the winning outcome and a card reader updates the monetary amount for provision of the award using the token to trigger transfer to an account via the card reader and a host system, and wherein a limit of selections is based on a number of game symbols appearing in a base game such that the higher the number of game symbols appearing the higher the limit of selections.

18. The machine of claim 17, wherein the selector game symbols are directional symbols indicating direction of movement of the pointer, and wherein the selector game symbols are masked or covered and revealed once selected.

19. The machine of claim 17, wherein the award is based on the prize symbol that the pointer points at in a final position including credits, free games, mega pot, small pot, and/or progressive pot.

20. The machine of claim 17, wherein a trigger mechanism for the interactive bonus game is based on the number of symbols appearing in the base game.

* * * * *